United States Patent [19]

Snyder et al.

[11] Patent Number: 4,715,992

[45] Date of Patent: Dec. 29, 1987

[54] FILTER ELEMENT REDUCTION METHOD

[75] Inventors: Thomas S. Snyder, Oakmont; Herbert A. Burgman, Murrysville; Edward Mitchell, Wilkinsburg, all of Pa.

[73] Assignee: Westinghouse Electric Corp., Pittsburgh, Pa.

[21] Appl. No.: 793,040

[22] Filed: Oct. 30, 1985

[51] Int. Cl.[4] ..... G21F 9/16; G21F 9/04

[52] U.S. Cl. ..... 252/628; 252/631; 252/635; 376/313

[58] Field of Search ..... 252/628, 631, 626, 635; 376/310, 313; 204/181.4, 181.6; 528/86, 89, 91, 92, 408, 409

[56] References Cited

U.S. PATENT DOCUMENTS

| | | | |
|---|---|---|---|
| 3,616,603 | 11/1971 | Warner | 55/97 |
| 3,902,981 | 9/1975 | Chu | 204/181.4 |
| 4,131,563 | 12/1978 | Bähr et al. | 252/628 |
| 4,230,597 | 10/1980 | Bustard et al. | 252/628 |
| 4,234,447 | 11/1980 | Hay, II et al. | 252/631 |
| 4,315,831 | 2/1982 | Morin et al. | 252/628 |
| 4,382,026 | 5/1983 | Drake et al. | 252/628 |
| 4,387,216 | 6/1983 | Irving | 528/408 |
| 4,405,512 | 9/1983 | Filter et al. | 252/628 |
| 4,452,733 | 6/1984 | Horiuchi et al. | 252/632 |

FOREIGN PATENT DOCUMENTS

| | | | |
|---|---|---|---|
| 0094008 | 11/1983 | European Pat. Off. | 252/628 |
| 2363474 | 6/1975 | Fed. Rep. of Germany . | |
| 2363475 | 6/1975 | Fed. Rep. of Germany | 252/628 |
| 2107917 | 5/1983 | United Kingdom | 252/628 |
| 0363273 | 3/1973 | U.S.S.R. . | |

OTHER PUBLICATIONS

Hawley, G., 1981, The Condensed Chemical Dictionary–Tenth Edition, Van Nostrand Reinhold Co., New York, pp. 120 and 171.

*Primary Examiner*—Stephen J. Lechert, Jr.
*Assistant Examiner*—Howard J. Locker
*Attorney, Agent, or Firm*—R. D. Fuerle

[57] ABSTRACT

Disclosed is a method of reducing the volume of a material containing addition polymerizable bonds by contacting the material with sufficient butyrolactone to dissolve the soluble organic material therein and form a slurry. About 0.1 to about 2% by weight, based on the slurry weight, of an addition polymerizable catalyst is added to polymerize and solidify the slurry. About 10 to about 50% by weight, based on total slurry weight, of an ethylenically unsaturated monomer, such as styrene, can be added to aid in the polymerization process. The process is especially suited to filter elements containing radioactive contaminants.

16 Claims, 1 Drawing Figure

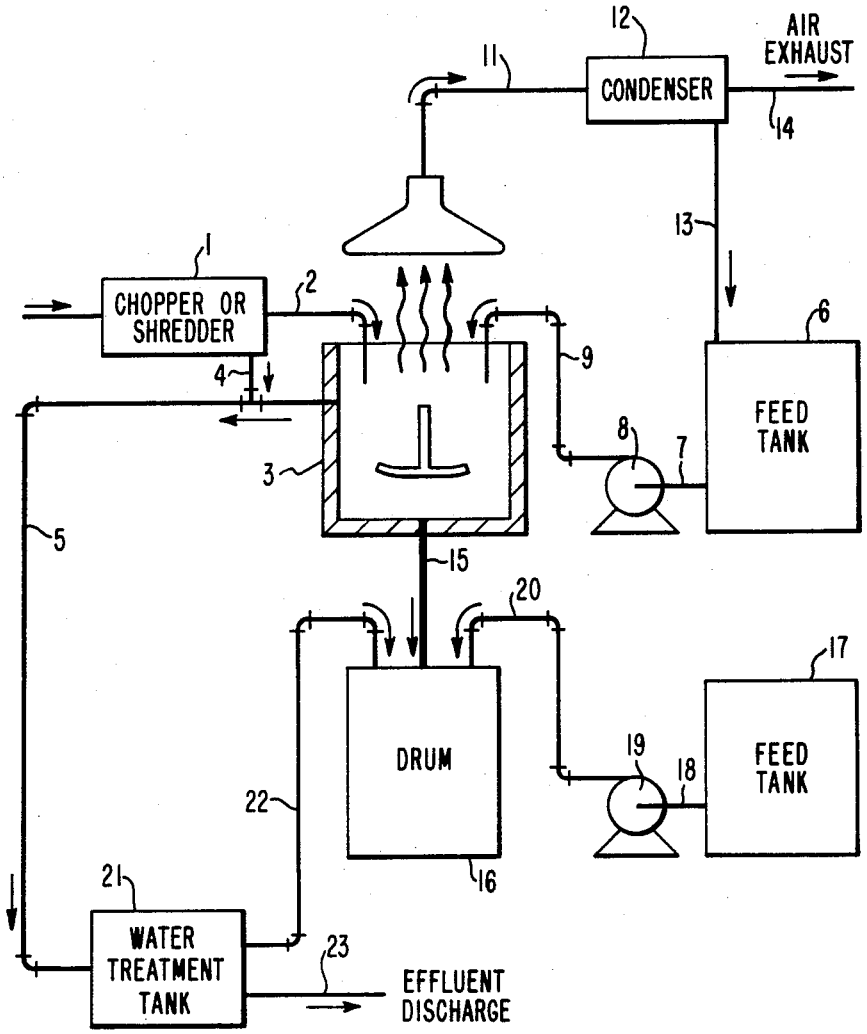
12
AIR EXHAUST
11
CONDENSER
14
13
1
CHOPPER OR SHREDDER
2
6
9
4
FEED TANK
8
7
3
5
15
20
17
DRUM
19
18
FEED TANK
22
16
21
WATER TREATMENT TANK
23
EFFLUENT DISCHARGE

FILTER ELEMENT REDUCTION METHOD

BACKGROUND OF THE INVENTION

Filter cartridges are widely used in the nuclear industry to filter streams containing radioactive materials. As these cartridges become exhausted and clogged they are removed and stored for later disposal. At the present time hundreds of thousands of these filter cartridges are awaiting a safe and economical method of disposal.

Disposal by incineration has the advantage of greatly reducing the volume of radioactive material that must be stored. However, temperatures of about 1500° F. are required to completely oxidize the organic materials in the filters, and at these temperatures heavy metals such as lead and arsenic, and radionuclides, such as ruthenium, may be volatized and present an environmental hazard. In addition, the filters contain significant amounts of radium which remains in the ash and requires extensive precautions to remove and dispose of.

Another method of disposing of the cartridges is to chop them up and encapsulate them in cement. While this is a widely accepted method of disposal, it greatly increases the volume of waste material that must be stored.

Still another possibility for disposing of the filter cartridges is to dissolve them in an organic solvent and chemically treat the solution. However, these cartridges consist of acrylic fiber and wood pulp bonded with a phenolic resin, and crosslinked phenolic resins are impervious to most types of chemical attack. Powerful solvents such as N-methyl-pyrrolidone, tetrahydrofuran, dioxane, and trichloroethylene all fail to disintegrate or dissolve the filters. Even caustic soda and dimethyl formamide, which were recommended by the seller of the filters, are ineffective in degrading or dissolving the filter cartridges.

SUMMARY OF THE INVENTION

We have discovered a single solvent that will dissolve these filter cartridges. Although every other solvent tried failed to dissolve the cartridges, we found that butyrolactone alone would dissolve the cartridges. In addition, we have found that once the filter cartridges are dissolved, the resulting slurry can be solidified by the addition of a suitable catalyst. The resulting solidified slurry reduces the bulk volume of the filter cartridges by a ratio of 3:1. The solidified slurry can then be stored in much the same way that radioactive material encapsulated in cement is stored.

DESCRIPTION OF THE INVENTION

The accompanying drawing is a diagrammatic view illustrating a certain presently preferred embodiment of the method of this invention.

In the drawing, filter cartridges are placed in a chopper or shredder 1 which comminutes them into easily dissolved pieces. The solid material passes through line 2 into dissolution tank 3, while the liquid material passes through line 4 into water purge line 5. Butyrolactone in feed tank 6 is pumped through line 7 by feed pump 8 to line 9 into dissolution tank 3 where it attacks and dissolves in the comminuted filter material. Vapors from tank 3 are collected in line 11 by condenser 12, and the condensed vapors pass through line 13 to feed tank 6, while air in line 14 is exhausted. The dissolved filter cartridges, along with undissolved material, passes as a slurry through line 15 into drum 16. A solidification agent is pumped from tank 17 through line 18 by feed pump 19 to line 20 into drum 16, where the polymerizable material polymerizes and solidifies, entrapping the solid waste material. Water in line 5 passes to water treatment tank 21, where the solids are separated by crystallization or evaporation. The solids can then be passed through line 22 to drum 16 for encapsulation, while the liquid is discharged in line 23 as an affluent.

The method of this invention is applicable to any contaminated material that is made with an addition polymerizable organic polymer; such materials contain ethylenically unsaturated double bonds. It is particularly applicable to materials containing large amounts of acrylics and phenolics because these materials are very difficult to dissolve and treat by any other method. A material well suited for treatment according to the process of this invention is one containing about 40 to about 50% by weight acrylic fiber and about 40 to about 50% phenolic resin; filter material may also contain about 5 to 12% wood pulp. While comminution of the material is not required, it is preferred because it greatly reduces the dissolution time.

In the first step in the process of this invention, the filter element material is contacted with sufficient butyrolactone to dissolve the organic matter present that is soluble in the butyrolactone. No more butyrolactone should be used than is necessary to dissolve this material since additional butyrolactone will unnecessarily add to the waste volume. Since some of the contaminants in the material, and possibly some of the organic materials themselves, will not be soluble in the butytrolactone, a slurry will be formed.

In the next step in the process of this invention, the polymerizable material in the slurry is cross-linked or polymerized to solidfy the slurry. This can be accomplished in the final storage container or it may be accomplished in a reaction vessel. The reactive mixture can then be poured into the final container before it solidifies. Solidification of the slurry is accomplished by the addition thereto of about 0.1 to about 2% by weight, based on the total slurry weight, of an addition polymerization catalyst. Less than 0.1% catalyst is ineffective and more than 2% is unnecessary. Such catalysts are well known in the art and are typically free radical initiators. Examples of suitable free radical initiators include triactin, benzoyl peroxide, and methyl ethyl ketone peroxide. Peroxides are preferred as they have been found to work well.

It is preferable to add about 10 to about 50% by weight, based on total slurry weight, of an ethylenically unsaturated monomer to the slurry to reduce the time required for the slurry to solidify. If less than 10% of the ethylenically unsaturated monomer is used, the time required for the slurry to solidify will not be reduced very much, and more than 50% will have minimal additional effect. Suitable ethylenically unsaturated monomers include butadiene, propylene, ethylene, maleic anhydride, and styrene. Styrene is preferred because it has been found to work very well. The ethylenically unsaturated monomer may have any molecular weight and, while it acts as a monomer in this reaction, it may itself be a polymer or an oligomer. The polymerization and solidification of the slurry will occur at room temperature, but it is preferable to heat the slurry between about 70° C. and about the boiling point of the ethylenically unsaturated monomer in order to speed the reaction.

While the method of this invention is particularly applicable to filter cartridges, it is also applicable to other materials of similar composition such as ion exchange resins and absorbents.

The following examples further illustrate this invention.

EXAMPLE 1

Type C-8 and F-8 Cuno filter cartridges manufactured by Robinson Myers were used in these experiments. The following table gives their composition:

| Component | Type C-8 (wt. %) | Type F-8 (wt. %) |
|---|---|---|
| Acrylic Fiber | 46.7 | 47.5 |
| Phenolic Resin | 45.0 | 44.0 |
| Wood Pulp | 8.3 | 8.5 |

The cartridges were cut into small pieces and placed in beakers containing butyrolactone, tetrahydrofuran, dioxane, and tetrachloroethylene at room temperature. Other pieces were placed in flasks containing N-methylpyrrolidone, dimethyl formamide, styrene, or caustic soda, and the solvents were refluxed at their normal boiling point. At the end of 24 hours it was found that butyrolactone was the only solvent that degraded or dissolved the filter cartridge. Specifically, 160 grams of type C-8 and F-8 filters dissolved in 400 cc of butyrolactone, resulting in a final solution volume of about 530 cc. This was a volume reduction factor of about 3:1 over the uncrushed filters.

EXAMPLE 2

A contaminant solution was prepared having the following composition:

| COMPONENTS | WEIGHT PERCENT |
|---|---|
| Trisodium Phosphate | 15.9 |
| Motor Oil | 15.9 |
| $Co(NO_3)_2).6H_2O$ | 39.2 |
| CsCl | 10.0 |
| $Sr(NO_3)_2$ | 19.0 |

The slurry prepared in Example 1 was mixed with the contaminant solution and various curing agents, and the mixture was cured and solidified. Leaching tests were performed on the solid product. The following table describes a solidification procedure and the percent leached of solids and strontium nitrate into deionized (DI) water.

| Solidification Procedure | Leaching Results: % Solids Leached | Leaching Results: $Sr(NO_3)_2$ |
|---|---|---|
| 1. 25 gm Filter Solution<br>2 gm Contaminant<br>Cured at 32° F. in $H_2O$<br>Solid leached for 32 days in DI water | .3158 gm = 15.8% | .1411 gm |
| 2. 25 gm Filter Solution<br>2 gm Contaminant<br>1 gm Triacetin<br>Cured in water at 32° F.<br>Solid leached for 32 days in DI water | .6745 gm = 33.7% | .2718 gm |
| 3. 25 gm Filter Solution<br>25 gm Styrene<br>0.25 gm Benzoyl Peroxide<br>Cured at 90° C. in oven | .6231 gm = 31.2%<br>.6267 gm = 31.3% | .2249 gm<br>.3535 gm |

-continued

| Solidification Procedure | Leaching Results: % Solids Leached | Leaching Results: $Sr(NO_3)_2$ |
|---|---|---|
| Solid leached for 32 days in 39 ml DI water | | |
| 4. 25 gm Filter Solution<br>5 gm Styrene<br>.05 gm Benzoyl Peroxide<br>2 gm Contaminant<br>Cured at 90° C. in oven<br>Solid leached for 32 days in DI water | .5869 gm = 29.3% | .2606 gm |
| 5. 50 gm Filter Solution<br>12.5 gm Styrene<br>12.5 gm Maleic Anhydride<br>.25 gm Benzoyl Peroxide<br>2 gm Contaminant<br>Cured at 90° C. in oven | No leaching data available | |
| 6. 25 gm Filter Solution<br>1 gm Triacetin<br>2 gm Contaminant<br>Cured to solid at 0° C. in water<br>Solid cured at 90° C. in oven | No leaching data available | |
| 7. 20 gm Filter Solution<br>5 gm Maleic Anhydride<br>.05 gm Benzoyl Peroxide<br>Cured in oven at 140° for 48 hours | No leaching data available | |
| 8. 20 gm Filter Solution<br>10 gm Maleic Anhydride<br>.1 gm Benzoyl Peroxide<br>2 gm Contaminant<br>Cured in oven at 140° C. for 48 hours | No leaching data available | |
| 9. 20 gm Filter Solution<br>20 gm Maleic Anhydride<br>0.2 gm Benzoyl Peroxide<br>2 gm Contaminant<br>Cured in oven at 140° C. for 48 hours | No leaching data available | |

We claim:

1. A method of reducing the bulk volume of material which comprises a phenolic resin and which contains addition polymerizable groups, comprising:

(A) contacting said material, including said phenolic resin, with sufficient butyrolactone to dissolve soluble organic material therein, including said phenolic resin and form a mixture;

(B) adding about 0.1 to 2% by weight, based on said mixture weight, of an addition polymerization catalyst, whereby said addition polymerizable groups are polymerized and said mixture is solidified.

2. A method according to claim 1 wherein said material is comminuted prior to being contacted with said butyrolactone.

3. A method according to claim 1 wherein said material is a filter cartridge contaminated with radioactive substances.

4. A method according to claim 1 including the additional step of adding to said mixture about 10 to about 50% by weight, based on total mixture weight, of an ethylenically unsaturated monomer.

5. A method according to claim 4 wherein said ethylenically unsaturated monomer is styrene.

6. A method according to claim 1 including heating said mixture at a temperature between about 70° C. and about the boiling point of said material to increase its rate of polymerization.

7. A method according to claim 1 wherein said addition polymerization catalyst is a peroxide.

8. A method according to claim 1 wherein said material is a filter element which comprises about 40 to about 50% by weight, based on total filter element weight, acrylic fiber, about 40 to about 50% by weight phenolic resin, and about 5 to about 12% by weight wood pulp.

9. A method of encapsulating radioactively contaminated filter element made with acrylic and phenolic materials comprising:

(A) comminuting said filter element;

(B) contacting said comminuted filter element with an amount of butyrolactone sufficient to dissolve the soluble portions thereof, including said phenolic materials, and form a slurry;

(C) adding to said slurry about 10 to about 50% by weight, based on total slurry weight, of an ethylenically unsaturated monomer;

(D) adding to said slurry about 0.1 to about 2% by weight based on total slurry weight of an addition polymerization catalyst; and (E) heating said slurry at a temperature between about 70° C. and about the boiling point of said ethylenically unsaturated monomer to effect its polymerization and solidify said slurry.

10. A method according to claim 7 wherein said ethylenically unsaturated monomer is styrene.

11. A method according to claim 9 wherein said addition polymerization catalyst is a peroxide.

12. A method according to claim 1 wherein said material contains insoluble material and said mixture is a slurry.

13. A method of dissolving a phenolic resinous material and forming a solution thereof comprising contacting said material with butyrolactone.

14. A method according to claim 13 including the additional last step of adding about 0.1 to about 2% by weight of an addition polymerization catalyst, whereby said solution is polymerized and solidified.

15. A method according to claim 13 wherein insoluble material is included in said phenolic resinous material.

16. A method according to claim 9 wherein said filter element comprises about 40 to about 50% by weight, based on total filter element weight, acrylic fiber, about 40 to about 50% by weight phenolic resin, and about 5 to about 12% by weight wood pulp.

* * * * *